US005940935A

United States Patent [19]

Julius

[11] Patent Number: 5,940,935

[45] Date of Patent: Aug. 24, 1999

[54] HINGE CONNECTION

[75] Inventor: Zachary Julius, Yonkers, N.Y.

[73] Assignee: Nice-Pak Products, Orangeburg, N.Y.

[21] Appl. No.: 09/065,142

[22] Filed: Apr. 23, 1998

[51] Int. Cl.[6] ..... E05D 1/06

[52] U.S. Cl. ..... 16/269; 16/260; 16/386; 16/387; 229/125.11; 229/198.3; 403/364

[58] Field of Search ..... 16/269, 234, 271, 16/268, 260, 225, 226, 227, 257, 386, 387; 220/840, 841, 842; 229/125.08, 125.11, 198.2, 198.3; 403/364, 119, 381; 312/109, 111, 293.2, 311, 140

[56] References Cited

U.S. PATENT DOCUMENTS

| | | | |
|---|---|---|---|
| 147,710 | 2/1874 | Thomson | 229/198.2 |
| D. 374,555 | 10/1996 | McMath | D3/272 |
| 470,291 | 3/1892 | Dowling . | |
| 634,369 | 10/1899 | Quimby | 16/268 |
| 1,370,457 | 3/1921 | Lincoln | 16/269 |
| 2,733,830 | 2/1956 | Ruskin | 220/31 |
| 3,005,228 | 10/1961 | Friend | 16/171 |
| 3,325,855 | 6/1967 | Good | 16/184 |
| 3,866,793 | 2/1975 | Mulligan | 220/840 |
| 5,070,577 | 12/1991 | Bonneville et al. | 16/260 |
| 5,341,983 | 8/1994 | McGrath | 229/198.2 |
| 5,398,870 | 3/1995 | Bienaime | 229/198.2 |

*Primary Examiner*—Chuck Y. Mah

*Attorney, Agent, or Firm*—Testa, Hurwitz & Thibeault, LLP

[57] ABSTRACT

A hinge connection comprising two members having a plurality of projections spaced apart by gaps, wherein when the projections of one member are engaged with the gaps of a second member, the hinge connection provides pivotable movement between the two members and the two members are difficult to disengage. One embodiment of the present invention is a hinge connection that joins a lid to a receptacle.

27 Claims, 5 Drawing Sheets

HINGE CONNECTION

FIELD OF INVENTION

The invention relates to a hinge connection and, more specifically, to a hinge connection between a lid and a receptacle.

BACKGROUND

A number of hinge connections are well known in the art. Well known hinge connections include those joining two members using hinge pins, in a door hinge or an eyeglass hinge, or those comprising a ball and socket arrangement found, for example, in a plastic cosmetics container. The disadvantage of a pin-type hinge connection is the relatively high cost of forming accurately aligned and well-fitted openings for receiving a pin. Further, the pin or its receiver may be broken or displaced. The disadvantage of a ball and socket hinge connection is that the ball is essentially free floating and therefore the member containing the ball portion of the hinge is frequently displaced from the member containing the socket edges. Further, one or more of the balls and/or sockets may be easily broken.

In addition, a hinge connection comprised of plastic, such as a lid to a disposable plastic box, may also be constructed by ultrasonically welding the edge of the lid to the outer edge of the receptacle. However, this method of hinge construction is relatively expensive and the welded material may eventually break apart. Further, the lids of such containers do not remain opened, e.g. the lid tends to fall shut, which may be an impediment to the intended use of the container. Therefore, there exists a need for a relatively low cost, sturdy hinge which enables an attached lid of a container to remain in an open position.

SUMMARY OF INVENTION

The present invention relates to a hinge connection between two members. The hinge connection joins a first member to a second member for pivotal and controlled movement of the first member about the second member. More particularly, the invention provides an economical hinge connection useful for providing pivotable movement between two members such as a lid and a receptacle, and exhibiting the feature of a defined angular operating limit.

An important feature of the present invention is that the hinge connection is comprised of two members, each having a plurality of projections separated by a plurality of gaps. The projections and gaps are sized and shaped relative to each other to permit pivotable engagement of the projections of one member with the gaps of the other member. It is an object of the invention to provide projections that can be engaged, for example, forcibly engaged, to provide a hinge connection having interdigitating projections so that the separate hinge pieces are capable of rotation with respect to one another but are not easily separable. Therefore, in one embodiment, the projections and gaps are shaped and sized to be joined together and remain as a hinge connection, but the precise dimensions of the projections and gaps are not particularly limited. In a preferred embodiment, the projections are wider at a more distal portion and narrower at a more proximal portion. Conversely, the gaps are wider at a more proximal portion than a more distal portion. An important feature of the hinge connection is that a portion of the projections of the first member fit inside the gaps of the second member but that another portion of the projections is wider than the width of the gaps so that, once engaged, the hinge pieces can rotate about the proximal edge of a portion of the second member, but cannot become easily detached.

The dimensions or functions of the members of the present invention are not limited, other than that a portion of the first member is joined to a portion of the second member by the hinge connection of the present invention. For example, the hinge connection may comprise any two objects requiring pivotable movement, such as two or more photographic frames joined together side by side or portions of a folding chair.

The invention relates to a hinge connection comprising two components, each having a plurality of projections spaced apart by gaps. The hinge connection provides pivotable movement of the two components about each other when the projections of one component are engaged with the gaps of the other component. An important feature of the invention is that the shape and width of the projections allow the components to be engaged with one another by force, for example by pushing the projections of the first member through the gaps defined by adjacent projections of the second member, the edges of the wide portion of adjacent projections of the first member inhibiting the easy disengagement of the projections of the second member, while allowing limited pivotable movement between the members. In one embodiment, the projections are wider at their more distal end than at their more proximal end and the gaps are wider at their more proximal end than at their more distal end. The precise size and shape of the projections are not limited, for example, they may be triangular, trapezoidal, conical, or spherical in shape.

In one embodiment, the first member is a receptacle or box and the second member is a lid. An important object of the invention is that the angular operating limit of the lid is predetermined by the angle of extension of the projections of the lid and the box, and is limited by the lid projections touching the side of the box and/or the box projections touching the side of the lid.

In some embodiments, the two components of the hinge connection are comprised of a flexible, deformable material such as, for example, plastic or sheet metal and mounted to a member methods well-known in the art, permitting the pivotable interconnection of the members. Alternatively, each component of the hinge connection comprises a member, constructed, for example, from a single piece of deformable material.

BRIEF DESCRIPTION OF THE DRAWINGS

These and other advantages of the invention may be more clearly understood with reference to the specification and the drawings, in which.

DETAILED DESCRIPTION OF THE INVENTION

Figure 1:
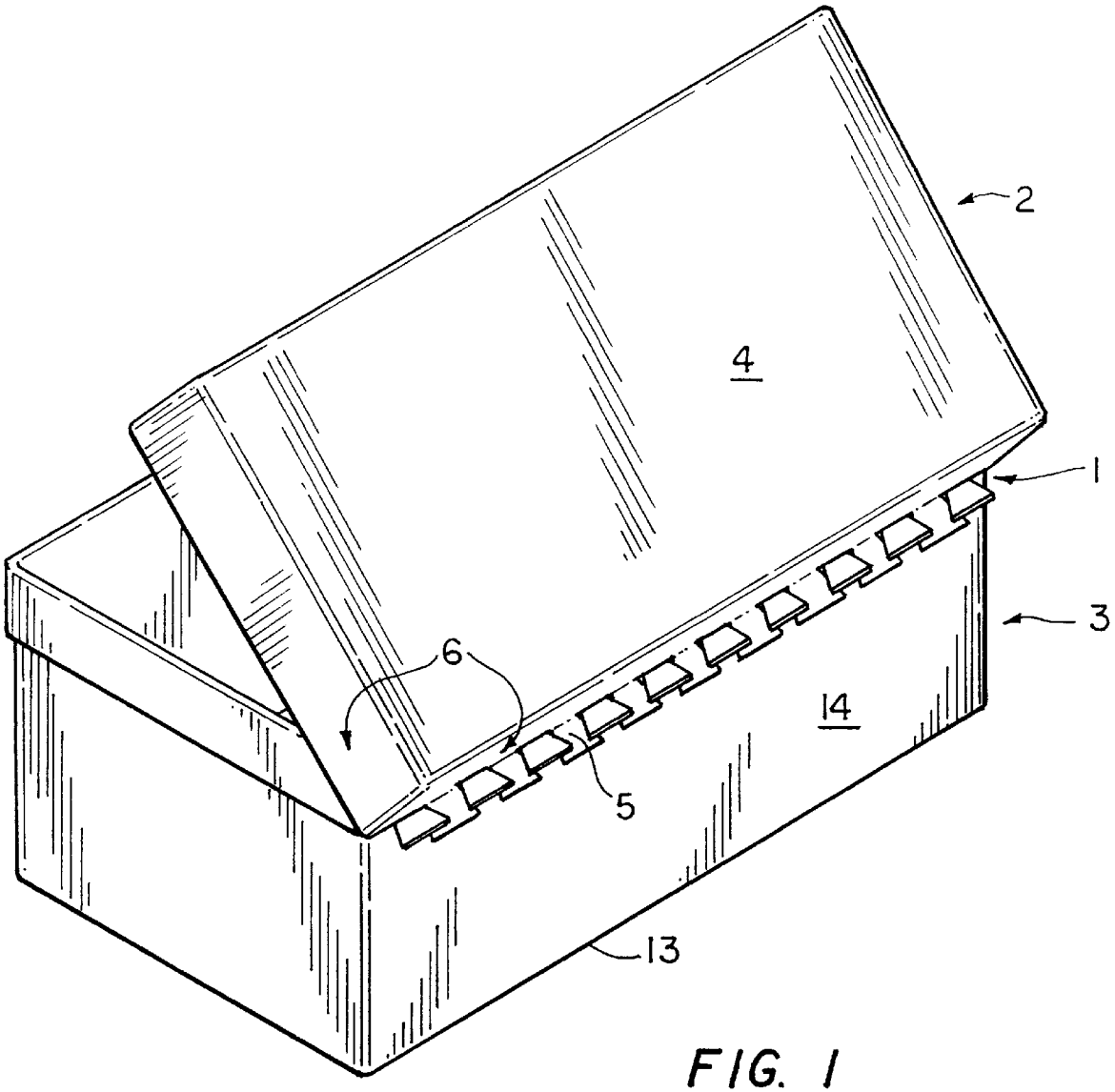
FIG. 1 a posterior side perspective of an embodiment of the invention.
Figure 2:
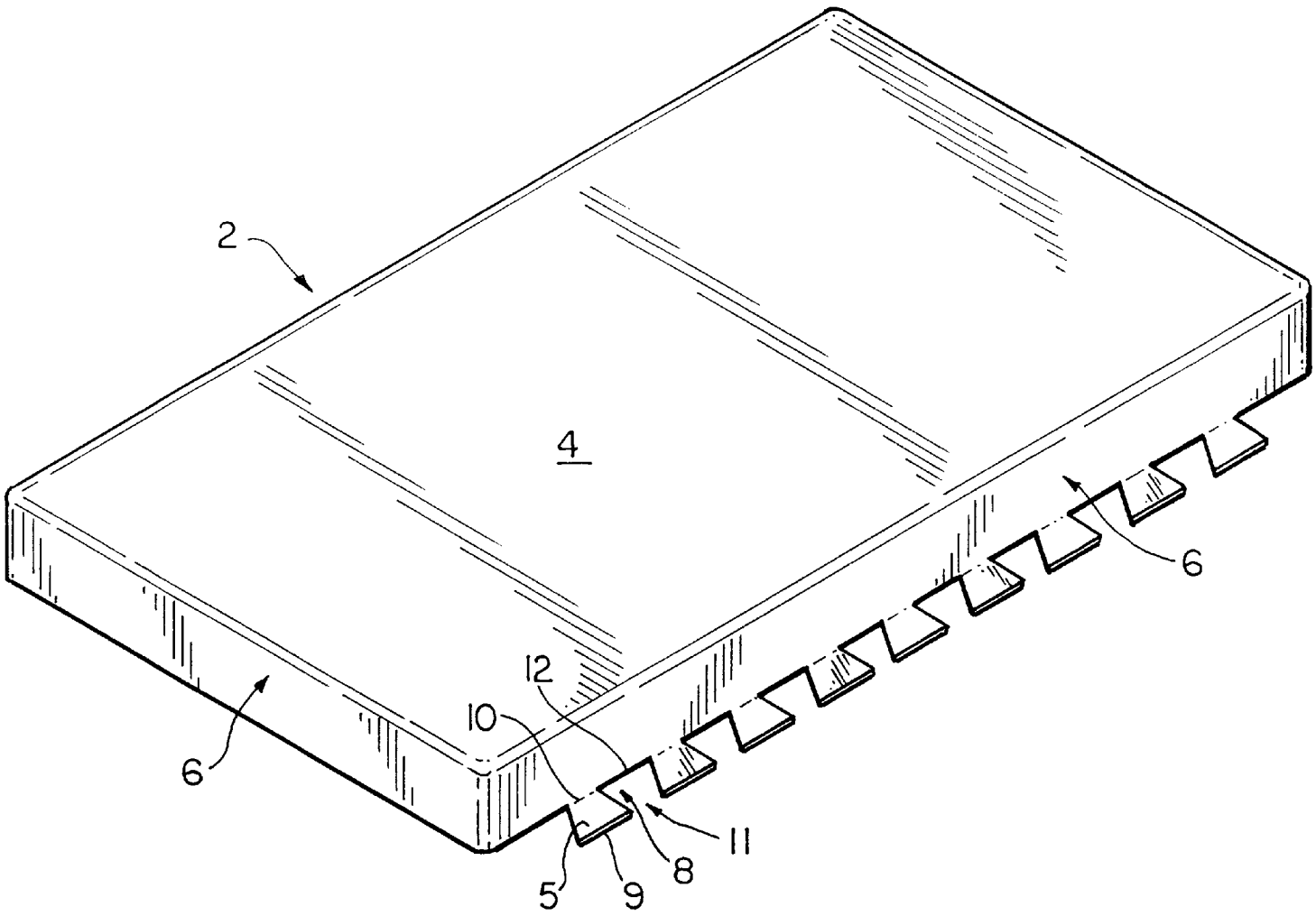
FIG. 2 is a top perspective of the lid portion of the embodiment shown in FIG. 1.

FIG. 1 illustrates one embodiment of the invention, wherein the hinge connection permits pivotable motion between a lid 2 and a receptacle 3. FIG. 2 shows a detail of an embodiment of the lid 2. The lid 2 includes a top face 4 and a plurality of projections 5 along one edge of the lid 2. The top face 4 may be substantially planar or, alternatively, may have a non-planar shape. For example, the lid may be concave or convex or any of a number of shapes, sizes, and textures provided the dimensions of the top face do not prevent the operability of the hinge connection.

The projections 5 of the lid 2 are each spaced apart by a gap 8 (FIG. 2). An important embodiment of the invention is that the gaps are sized and shaped to allow engagement with the projections 5 and pivotable movement without being easily disengaged. For example, in the embodiment of the invention pictured in FIG. 2, each of the projections 5 have a more distal end 9 and a more proximal end 10 and each of the gaps 8 have a more distal end 11 and a more proximal end 12. Each projection 5 must have a narrower portion at the more proximal end 10 and each of the gaps 8 must have a wider portion at the more proximal end 11. For example, in an embodiment of the invention, the shape of the projections 5 is essentially flat and triangular or essentially flat and trapezoidal (FIG. 2). In other embodiments the projections are not flat and can be ovoid, spherical, or conical in shape, for example. It is an important aspect of the invention that a portion of each projection 5 is wider than the remaining portion of the projection so that once the lid projections are engaged with the receptacle, the width or shape of the lid projections prevents their easy disengagement.

In an embodiment of the invention, the lid may further comprise perpendicular side faces 6. The sides 6 of the lid 2 may be of equal height or may be variable in height, thereby providing a space or spaces between portions of the lid 2 and the receptacle 3 when the hinge connection 1 is operable and the lid 2 is closed. For example, an embodiment of the present invention is a children's safety toy box in which there is a space between the front opening of the lid and the box, as a safety feature and for ease in grasping and opening the lid.

Figure 3:
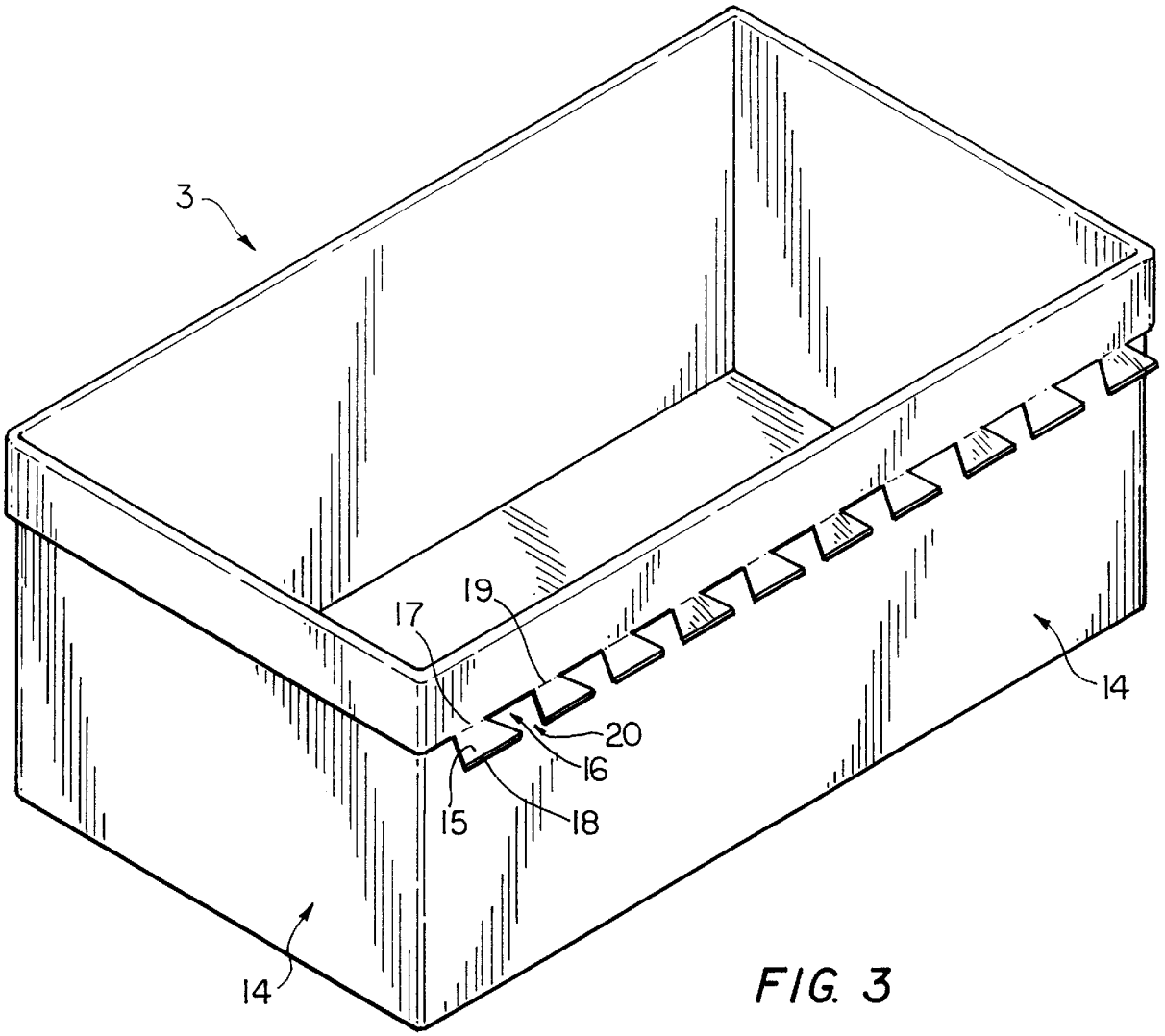
FIG. 3 is a top perspective of the receptacle portion of the embodiment shown in FIG. 1.
Figure 5:
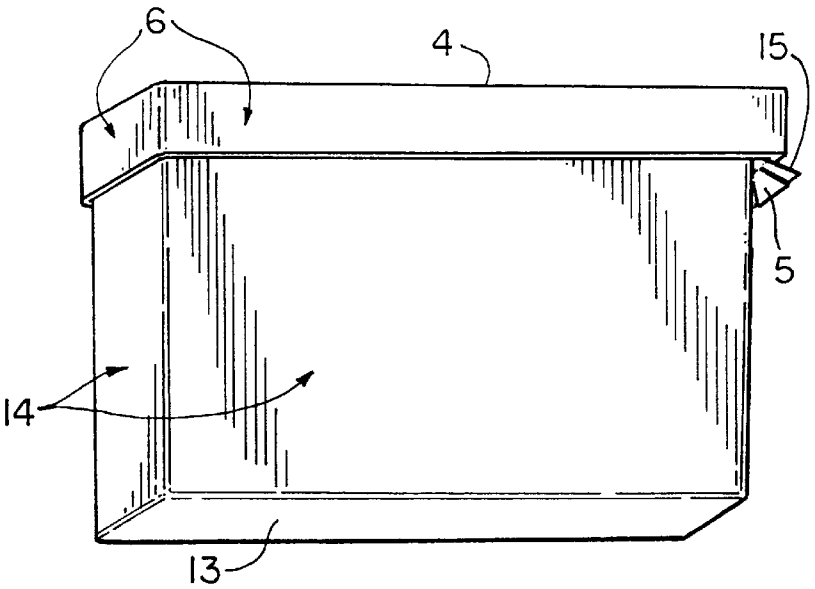
FIG. 5 is a side perspective of the receptacle and lid of the embodiment shown in FIG. 1, lid closed.

One preferred embodiment of a receptacle is a substantially rectilinear box 3 including a base 13 with a plurality of essentially perpendicular sides 14 (FIG. 3). However, any shape of receptacle is anticipated, provided the hinge connection of the invention may be used to provide pivotable movement between the receptacle and another member. The sides 14 of the box 3 may be of equal height and/or shape or may by variable in height and/or shape, thereby providing a space or spaces between a portion or portions of the lid 2 and the box 3 when the hinge connection is operable and the lid 2 is closed.

On one of said sides 14 of the box 3 is a plurality of projections 15. Each projection 15 is spaced apart by a gap 16 (FIG. 3). Each of the projections 15 has a more distal portion 18 and a more proximal portion 17. In one embodiment, each projection 15 has a narrower portion at the more proximal end 17 and each of the gaps 16 has a wider portion at the more proximal end 19. The projections 5 of the lid 2 are spaced to be in alignment to engage with the gaps 16 of the box 3 and the projections 15 of the box 3 are spaced to be in alignment to engage with the gaps 8 of the lid 2 (FIG. 1).

Figure 4:
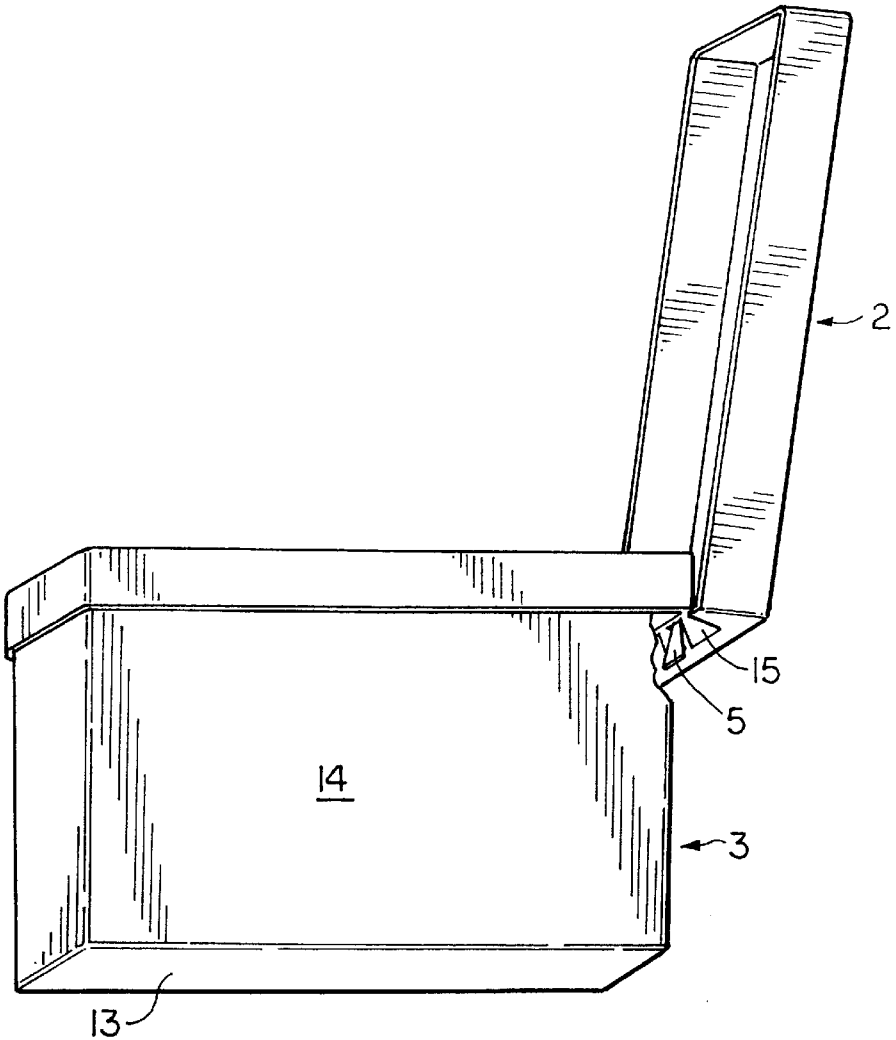
FIG. 4 is a side perspective of the receptacle and lid of the embodiment shown in FIG. 1, lid open.

In one embodiment, the projections are substantially parallel to the plane of the top face 4 of the lid 2. The plurality of projections can be, for example, welded to the lid, attached to the lid with rivets or screws or, preferably, formed from the same piece of material as the lid. The angle at which the projections extend provides ample room for the pivotable movement between the lid and receptacle by the hinge connection. In one embodiment, projections 5 of the lid 2 are co-planar and extend at an angle of about −45° to about +45° relative to the plane of the top face 4 of the lid 2. Preferably the projections 5 extend at an angle of about −10° to about +10° relative to the plane of the top face 4 of the lid 2. The angle at which the projections 5 extend outward from the lid depends upon the desired operating limit of the hinge or the desired degree of pivotability of the lid 2 relative to the receptacle 3. "Operating limit" is defined herein as the angle of operation of the hinge or the extent to which the second member can rotate about the hinge axis before it stops. The desired angle of extension of the projections is also dependent upon the precise dimensions and limitations provided by the lid and/or the receptacle. For example, the sides of the lid and the sides of the receptacle may prevent the lid from opening completely; as shown in FIG. 4 the lid opens to approximately 90° because the projections 5 of the lid 2 rest against the side of the box 3 and the projection 15 of the box 3 rests against the side of the lid 2 when the lid is opened.

In another embodiment, the plurality of projections 5 may be non-planar to each other and may extend at different angles from the lid 2. In another embodiment the projections 15 are essentially perpendicular to the edge of one of the sides 14 of the receptacle 3. In yet another embodiment, the plurality of projections 15 may be co-planar to each other. In still another embodiment the projections 15 may extend at different angles from the receptacle 3.

In a further embodiment and referring primarily to FIG. 3, the projections 15 may be shaped so that they exert downward force on corresponding projections 5 from a lid member, i.e., the projections 15 may have a downward bend which exerts force on corresponding lid projections 5, projections 15 may be slanted downward so that they are capable of exerting pressure on corresponding lid projections 5, or projections 15 may be provided with bosses which extend downwardly for exerting pressure on lid projection 5. In this embodiment, the lid member 4 is held in a slightly open position because of the force exerted on the lid projections 5 by the receptacle projection 15. It is desirable that at least the receptacle projections are fabricated from a slightly resilient material so that the receptacle projections 15 are capable of slightly deforming, thereby allowing the lid 4 to close. It is expected that the lid 4 would be equipped with a latch that would keep it in place and, in this embodiment, the lid 4 would spring open when unlatched because of the downward force exerted on the lid projections 5.

The shape and width of the projections 5 of the second member 2 and projections 15 of the first member 3 allow for the pivotable engagement of the narrow portion of the projections 5 of the second member 2 through the gaps defined by the projections 15 of the first member 3, whereby the edges of the wide portion of the projections 5 defines a space that allows engagement and pivotal movement of the second member 2 about the first member 3 but prevents the disengagement of the projections 5 and 15.

In a preferred embodiment, engagement of the plurality of projections 5 of the lid 2 and the gaps 16 defined by the plurality of projections 15 of the receptacle 3 provides a pivotable connection between the lid 2 and the box 3 (FIGS. 1–5). When the projections 5 of the lid 2 are engaged with the gaps 16 defined by the projections 15 of the receptacle 3, the narrow proximal portion 10 of the projections 5 are engaged with the wide proximal portion 19 of the gaps 16 of the receptacle 3 and are pivotable thereby. In one embodiment, the narrow portion 20 of each gap 16 is narrower than the narrow portion 10 of each projection 5, thereby providing a hinge connection which would require substantial force to disengage the projections 5 from the gaps 16 or the projections 15 from the gaps 8, in order to disconnect the lid from the receptacle. In another embodiment, when the projections 5 of the lid 2 are engaged with the gaps 16 defined by the projections 15 of the receptacle 3, the wide portion 19 of each gap 16 is slightly wider than the widest portion 9 of each projection 5.

The operating range of the present invention comprises the angular distance from the top of the lid 2 to the side 16 of the receptacle 3 and is between 0° and 360°. A preferred angular operating range of the pivotable movement of the hinge connection 1 is about 90° relative to the plane of the side 14 of the receptacle 3, for example. In one embodiment, the operating limit of the hinge connection 1 of the present invention occurs when the plurality of projections 5 of the lid 2 are limited by contact with the adjacent perpendicular side 14 of the receptacle 3 (FIG. 4). In another embodiment, the operating limit of the hinge connection 1 of the present invention occurs when the plurality of projections 15 of the receptacle 3 are limited by contact with the perpendicular side 6 of the lid 2 (FIG. 4).

In one embodiment of the present invention the hinge components are composed of a material capable of slight deformation in order to engage the hinge components with limited force. Materials capable of slight deformation useful in the present invention are, but are not limited to, flexible sheet metals or plastics. A preferred material for making either the lid 2 and the box 3 is a single sheet of thermolabile plastic which is capable of being molded, and having projections of a size, shape and material capable of slight deformation in order to provide engagement of the lid projections with the box gaps deformed slightly. Alternatively, the projections 5 or the projections 15 of the hinge components of the present invention may be comprised of a deformable material and mounted to a member, and the members may be comprised of a material that need not be deformable or bendable such as, for example, wood.

One embodiment for engaging the hinge components comprises aligning the narrow portion of the projections 5 of the lid 2 with the gaps 16 of the receptacle 3 and applying forcible pressure to engage or snap the projections 5 into place within the gaps 16. This may be achieved using automated machinery capable of gripping both members, aligning the gaps of the first member with the projections of the second member and forcibly pushing the projections through the gaps until engaged.

Figure 6:
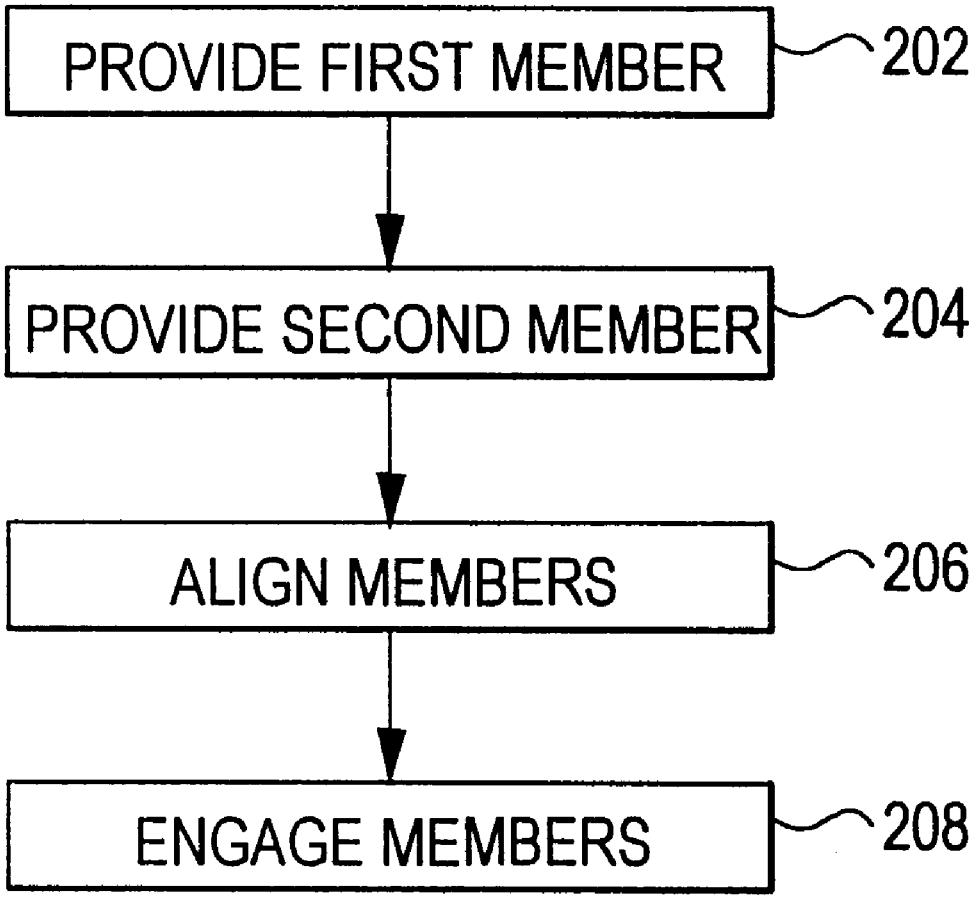
FIG. 6 is a flowchart of the steps to be taken in forming a hinge connection.

Referring now to FIG. 6, and in brief overview, a method for making a hinge connection which joins to members includes the steps of providing a first member that has a plurality of projections as described above, providing a second member having a plurality of projections as described above, aligning the projections of the first member with the gaps created by the projections of the second member, and engaging the projections of the first member with the gaps of the second member. The members may be any device as described above, for example, the members may respectively be a lid and its associated receptacle, two display members which are intended to be pivotable with respect to each other, or the first member may be a door which pivotally engages with a wall member.

In order to make a hinge connection, a first member is provided (Step 202), a second member is provided (Step 204), and the projections of the first member are aligned with the gaps formed by the projection of the second member (Step 206). As noted above, the projection of the members may have any shape so long as the projections are wider at their more distal end than at their more proximal end. Depending upon the members to be pivotally connected, individual members may be provided and aligned or, in the alternative, a single piece comprising more than one individual member may be provided and aligned with a second piece comprising more than one of the second members. After the pivotal connection is made, individual pieces may be cut from the assembled hinge connection.

Once the members are provided and aligned, the projections of the first member are engaged with the gaps of the second member (Step 208). It is expected that physical force will be used to engage the projections of the first member with the gaps of the second member. As the projections of the first member are pushed through the gaps of the second member, the projections of the first member deform slightly in order to allow them to fit through the gaps provided by the second member. Once through, the projections of the first member should return to their original shape. This prohibits the first member from being casually disengaged from the second member, since it is expected that a greater force is used to engage the first member and the second member than will occur in casual use of the hinge connection.

In one embodiment, a lid is provided that has a plurality of projection as described above and a receptacle is provided which also has a plurality of projections as described above. Any method may be used to provide these two members, for example, the receptacle may ride along a conveyor belt while a gripper moves the lid in a corresponding speed and direction. At some point in the process, the gripper forces the lid down onto the receptacle, which should be held in place to avoid dislodging it from the conveyor belt. After successfully engaging the projections of the lid with the gaps of the receptacle, the gripper releases the lid and the hinge connecting the lid to the receptacle is assembled.

In another example, it is expected that a lid member is provided as described above, but the second member which is provided is simply a flange which has a series of projections. The projections of the lid are engaged with the gaps of the flange in any manner described above. The completed lid and flange assembly is then connected to a receptacle or some other member to which it is desired to connect the lid by connecting the flange to the second member using any connection method well known in the art, such as nailing, screwing, gluing, ultrasonically welding, soldering, fusing, bolting, crimping, or riveting.

The invention may be embodied in other specific forms without departing from the spirit or essential characteristics thereof. The foregoing embodiments are therefore to be considered in all respects illustrative rather than limiting on the invention described herein. Scope of the invention is thus indicated by the appended claims rather than by the foregoing description, and all changes that come within the meaning and range of equivalency of the claims are intended to be embraced therein.

What is claimed is:

1. A hinge connection between two members, at least one of which is pivotable relative to the other, comprising:

a first member having a first plurality of projections, each of said first projections having an end proximal to said first member and an end distal to said first member, said first projections having a width which is greater at the more distal end than at the more proximal end;

a second member pivotally connectable to said first member and having a second plurality of projections, each of said second projections having an end proximal to said second member and an end distal to said second member, said second projections having a width which is greater at the more distal end than at the more proximal end;

said projections spaced apart by gaps having a distal end and a proximal end and having a width which is greater at the more proximal end of said gap than at the more distal end of said gap;

said first plurality of projections spaced apart in alignment to engage with said gaps adjacent to each of said second projections to provide a pivotal connection for pivotal movement of said second member relative to said first member within a certain predetermined angular operating range when said projections of said first member are movably engaged with said gaps of said second member.

2. The hinge connection of claim 1 wherein said width of said more distal end of said projections is greater than said width of said more proximal end of said gaps.

3. The hinge connection of claim 1 wherein said projections of said first member are on the edge of the terminus to a side of a receptacle, said receptacle comprising a bottom face and adjacent side faces substantially perpendicular to said bottom face.

4. The receptacle of claim 3 wherein said projections of said first member are substantially perpendicular to said side of said first member and substantially parallel to said bottom face of said first member.

5. The hinge connection of claim 3 wherein said second plurality of projections are on the edge of a substantially planar surface.

6. The receptacle of claim 5 wherein said projections of said second member are substantially parallel to said planar surface of said second member.

7. The hinge connection of claim 3 wherein the predetermined operating range is limited by one side face of said receptacle.

8. The hinge connection of claim 1 wherein the angular operating range of the pivotal movement is between 90° and 360°.

9. The hinge connection of claim 1 wherein all said projections are collinear.

10. The hinge connection of claim 1 wherein said first member defining a plane, said first projections extend at an angle of about −45° to about +45° relative to the plane of said first member.

11. The hinge connection of claim 1 wherein said first member is formed from a single piece of flat material and said second member is formed from a single piece of flat material.

12. The hinge connection of claim 11 wherein said material is capable of slight deformation.

13. A process for making a hinge connection for joining two members in pivotable connection for pivotal movement, the process comprising, (a) providing a first member having a first plurality of projections, each of said projections including an end proximal to said first member and an end distal to said first member, said first projections having a width which is greater at the more distal end than at said more proximal end, said first projections spaced apart by a first plurality of gaps, each of said first gaps having an end proximal to said first member and an end distal to said first member;

(b) providing a second member pivotally connectable to said first member and having a second plurality of projections, each of said projections including an end proximal to said second member and an end distal to said second member, said second projections having a width which is greater at the more distal end than at the more proximal end, said second projections spaced apart by a second plurality of gaps, each of said second gaps having an end more proximal to said second member and an end more distal to said second member;

(c) aligning said first plurality of projections with said second plurality of gaps adjacent to each of said second projections of said second member; and (d) engaging the projections of said first member with the gaps of said second member to provide a pivotal connection for pivotal movement of said first member relative to said second member within a certain predetermined angular operating range.

14. The process for making a hinge connection of claim 13 wherein engaging the projections of said first member with the gaps of said second member of (d) comprises forcibly pushing or snapping into place the narrow portion of said projections of said first member through the narrow portion of said gaps of said second member into the wider portion of said gaps of said second member.

15. A hinge connection between a lid and a receptacle, said lid being pivotable relative to said receptacle, comprising:

a first plurality of projections extending from the receptacle, each of said first projections having a width which is greater at the end more distal to the receptacle than at the end more proximal to the receptacle;

a second plurality of projections extending from said lid, each of said second plurality of projections having a width which is greater at the more end distal to the lid than at the more end proximal to the lid;

said projections spaced apart by gaps having a width that is greater at the more proximal end of said gaps than at the more distal end of said gaps;

said plurality of projections of said receptacle spaced apart in alignment to engage with said gaps adjacent to each of said second projections of said lid, to provide a pivotal connection for pivotal movement of the receptacle relative to the lid within a certain predetermined angular operating range when the projections of the receptacle are movably engaged with the gaps of the lid.

16. The hinge connection of claim 15 wherein said receptacle comprises a substantially rectilinear box and said lid is substantially rectilinear and substantially planar.

17. The hinge connection of claim 15 wherein the projections of said receptacle are on the edge of the terminus to a planar surface comprising a side of said receptacle, said receptacle comprising a bottom face and adjacent side faces substantially perpendicular to said bottom face.

18. The hinge connection of claim 15 wherein the predetermined operating range comprises the angular distance from said lid to one side of said receptacle.

19. The hinge connection of claim 15 wherein said projections of said receptacle are substantially perpendicular to the outer surface of said side of said receptacle and substantially parallel to said bottom face of said receptacle.

20. The hinge connection of claim 15 wherein said lid defining a plane, said first and second plurality of projections, when pivotably engaged with said gaps, are at an angle of about −90° to about +90° relative to the plane of said lid.

21. The hinge connection of claim 15 wherein each of said projections has a substantially triangular shape.

22. The hinge connection of claim 15 wherein each of said projections has a substantially trapezoidal shape.

23. The hinge connection of claim 15 wherein each of said projections is substantially planar.

24. The hinge connection of claim 15 wherein said receptacle is formed from a single piece of flat material and said lid is formed from a single piece of flat material.

25. The hinge connection of claim 24 wherein said material is capable of slight deformation.

26. The hinge connection of claim 15 wherein said projections are spaced evenly apart.

27. The hinge connection of claim 15 wherein said distal width of said projections is greater than said proximal width of said gaps.

* * * * *